US005893495A

United States Patent [19]

Godshaw et al.

[11] Patent Number: 5,893,495

[45] Date of Patent: Apr. 13, 1999

[54] CONVERSION APPARATUS FOR A BACKPACK

[75] Inventors: Donald Godshaw, Evanston; Andrzej Redzisz, Des Plaines, both of Ill.

[73] Assignee: Travel Caddy, Inc., Des Plaines, Ill.

[21] Appl. No.: 08/953,887

[22] Filed: Oct. 20, 1997

[51] Int. Cl.[6] ..... A45F 4/02

[52] U.S. Cl. ..... 224/153; 224/575; 190/115

[58] Field of Search ..... 224/153, 577, 224/575, 576; 150/108; 190/115

[56] References Cited

U.S. PATENT DOCUMENTS 4,679,671 7/1987 Kobayashi ..... 224/153

5,022,574 6/1991 Cesari ..... 224/153

5,671,832 9/1997 London et al. ..... 190/115

*Primary Examiner*—David J. Walczak

*Attorney, Agent, or Firm*—Douglas B. White

[57] ABSTRACT

A backpack styled luggage item having an extendable handle and a pair of wheels. The shoulder straps of the backpack are tethered to the extendable handle such that extension of the handle lifts the shoulder straps up and against the luggage to allow safe transport on the wheels. In a further feature, a movable flap is provided to cover and pad the wheels while the luggage is carried.

15 Claims, 3 Drawing Sheets

CONVERSION APPARATUS FOR A BACKPACK

BACKGROUND OF THE INVENTION

1. Field of the Invention

This invention relates generally to backpack style luggage, and more particularly to apparatus for facilitating its conversion to wheeled luggage.

2. Description of the Prior Art

Prior art backpack style luggage is typically carried by means of straps arranged to hang on one's shoulders; but with heavy packs, it is desireable to have an alternative means of transport. Nevertheless, apparatus has not previously been available for efficiently transporting this luggage in a wheeled manner, aside from simply placing the luggage in a cart.

SUMMARY OF THE INVENTION

Accordingly, it is the object of this invention to provide apparatus for facilitating the wheeled transport of backpack style luggage, including apparatus for controlling loose shoulder straps.

These and other objectives are achieved by providing a backpack styled item of luggage with an extendable handle and providing a pair of wheels on the bottom. The shoulder straps of the backpack are tethered to an extendable handle such that extension of the handle pulls the shoulder straps up and against the luggage to allow safe transport on the wheels. In a further feature, a movable flap is provided to cover and pad the wheels while the luggage is carried on one's back.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
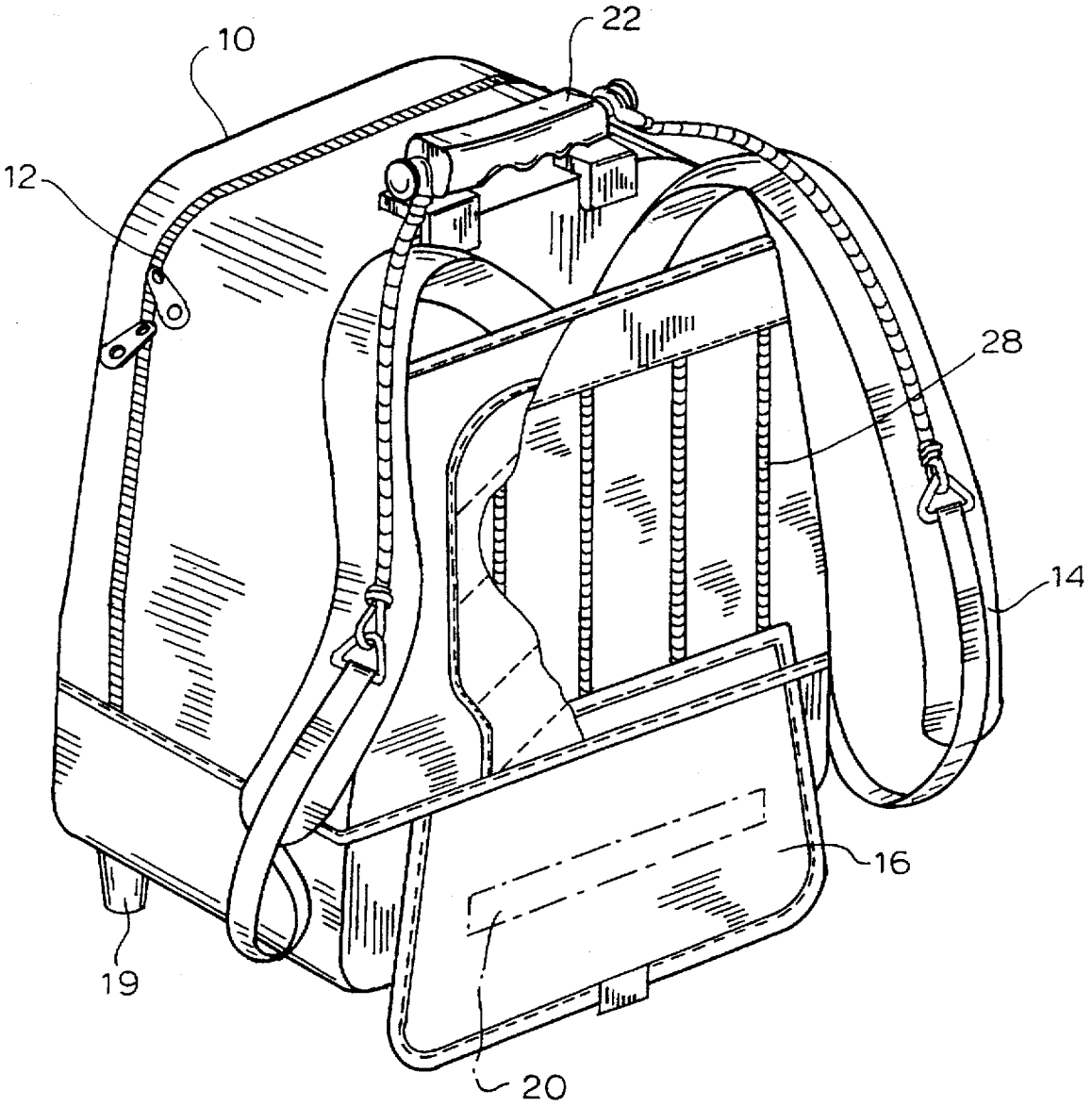
FIG. 1 is a perspective view of the luggage of the present invention, partially cut away, showing the wheel pad extended to cover the wheels and with the handle retracted.
Figure 2:
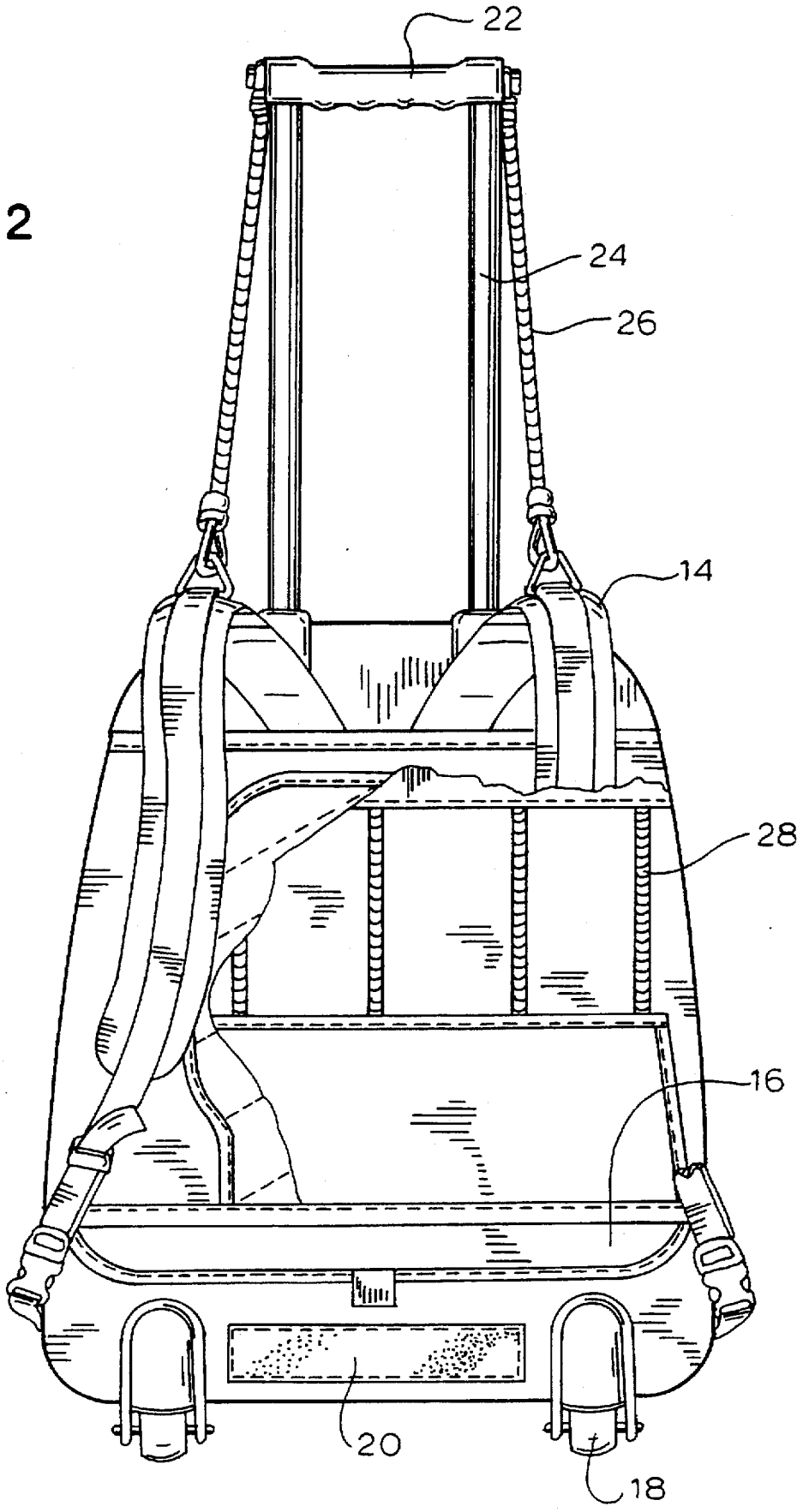
FIG. 2 is a rear view of the luggage of FIG. 1 with the wheel pad retracted and the handle extended.

Turning first to FIG. 1 there is shown a backpack having a conventional bag portion 10, a zippered opening 12, and shoulder straps 14. When carried as a backpack, the padded flap 16 is extended to cover wheels 18 (shown in FIG. 2) and a hook/loop fastener device 20 (such as a Velcro hook/loop fastener) is employed to hold the padded flap 16 in place. When placed on the floor the backpack stands upright on the rear wheels 18 and the front feet 19.

Figure 3:
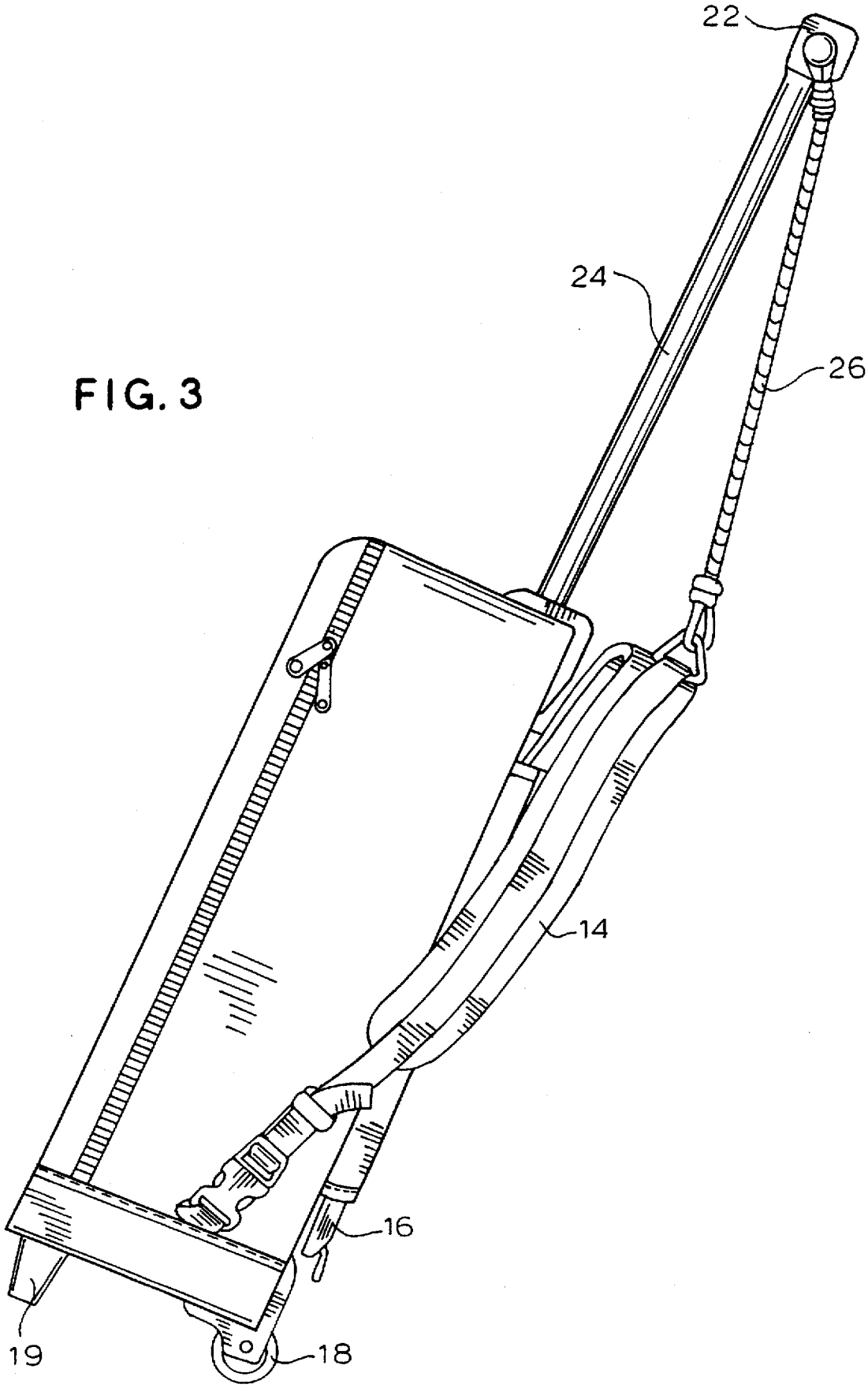
FIG. 3 is a side view of the luggage of FIG. 2 showing the tethered lift of the shoulder straps.

When it is desired to convert this backpack to wheeled luggage, a handle 22, having sliding (or telescoping) extensions 24 (FIG. 2) is extended upwardly. When not extended this handle slides into the backpack for storage as shown in FIG. 1. During extension the handle pulls flexible elastic cord-like tethers 26 up with it to thereby pull the shoulder straps 14 up and against the backpack. Upon release of the hook/loop fastener 20, the padded flap 16 retracts into a storage area in the backpack under bias from elastic cords 28 positioned within the backpack, exposing the wheels 18 positioned on the bottom rear edge of the backpack. As shown in FIG. 3, the luggage can now be tilted back onto the wheels under control of the extended handle for rolling transport.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A backpack comprising:

a bag member having a top and bottom defined thereon and having shoulder straps affixed thereto;

wheel means affixed to said bottom of said bag member;

an extendable handle member affixed to said bag member for selective upward extension; and tether means connected between said handle member and said shoulder straps, wherein said shoulder straps are pulled upwardly during extension of said handle member.

2. The backpack of claim 1 wherein said handle member slidably extends from a storage position within the backpack.

3. The backpack of claim 2 wherein said tether means comprises flexible members.

4. The backpack of claim 3 wherein said flexible members exhibit elastic cord-like properties.

5. The backpack of claim 1 wherein said wheel means is mounted to a rear portion of said bottom of the backpack.

6. The backpack of claim 5 further comprising a movable flap arranged to selectively provide padding against said wheel means.

7. The backpack of claim 6 further comprising fastening means for releasably securing said flap in position against said wheel means.

8. The backpack of claim 7 wherein said fastening means comprises a hook/loop device.

9. The backpack of claim 2 wherein said wheel means is mounted to the rear portion of said bottom of the backpack.

10. The backpack of claim 9 further comprising a movable flap arranged to selectively provide padding against said wheel means.

11. The backpack of claim 10 further comprising fastening means for releasably securing said flap in position against said wheel means.

12. The backpack of claim 4 wherein said wheel means is mounted to the rear portion of said bottom of the backpack.

13. The backpack of claim 12 further comprising a movable flap arranged to selectively provide padding against said wheel means.

14. The backpack of claim 13 further comprising fastening means for releaseably securing said flap in position against said wheel means.

15. The backpack of claim 14 wherein said fastening means comprises a hook/loop device.

* * * * *